US006456254B1

(12) United States Patent
Reineix et al.

(10) Patent No.: US 6,456,254 B1
(45) Date of Patent: Sep. 24, 2002

(54) LAMINATED DIELECTRIC REFLECTOR FOR A PARABOLIC ANTENNA

(75) Inventors: Alain Reineix, Rilhac Rancon; Marc Thevenot, Limoges; Bernard Jecko, Rilhac Rancon, all of (FR)

(73) Assignee: Centre National de la Recherche Scientifique (FR)

( * ) Notice: Subject to any disclaimer, the term of this patent is extended or adjusted under 35 U.S.C. 154(b) by 0 days.

(21) Appl. No.: 09/856,406

(22) PCT Filed: Nov. 17, 1999

(86) PCT No.: PCT/FR99/02816

§ 371 (c)(1),
(2), (4) Date: May 16, 2001

(87) PCT Pub. No.: WO00/30215

PCT Pub. Date: May 25, 2000

(30) Foreign Application Priority Data

Nov. 17, 1998 (FR) ..... 98 14394

(51) Int. Cl.[7] ..... H01Q 15/16

(52) U.S. Cl. ..... 343/840; 343/912

(58) Field of Search ..... 343/840, 912, 343/914, DIG. 2, 915, 908, 909

*Primary Examiner*—Don Wong
*Assistant Examiner*—James Clinger
(74) *Attorney, Agent, or Firm*—Blakely Sokoloff Taylor & Zafman

(57) ABSTRACT

The invention provides a reflector forming a parabolic antenna, the reflector being characterized by the fact that it is made up of n contiguous layers of dielectric material defined by n+1 surfaces having distinct parabolic equations and shaped to define a common electromagnetic focus.

32 Claims, 4 Drawing Sheets

LAMINATED DIELECTRIC REFLECTOR FOR A PARABOLIC ANTENNA

The present invention relates to the field of parabolic antennas.

So far as the inventors are aware, the parabolic reflectors that are commonly used nowadays are made of structures that are either entirely metallic or least that are provided with metallization that provides the reflecting surface.

Such reflectors have indeed given good service. However they present the following features:

metallic losses;

reflection is not frequency selective;

poor appearance;

manufacture is not trivial; and they deform with temperature.

Attempts have been made to implement reflecting structures, including parabolic reflectors, based on a stack of dielectric sheets (see document DE-A-3 601 553). Nevertheless, at present, attempts based on that type of technology have not given satisfaction.

An object of the present invention is to propose a novel parabolic antenna that enables the drawbacks of the prior art to be eliminated.

According to the present invention, this object is achieved by a reflector made up of n contiguous layers of dielectric material defined by n+1 surfaces having distinct parabolic equations and shaped to define a common electromagnetic focus.

According to an advantageous additional 30 characteristic of the present invention, each layer is a uniform piece of dielectric (plastic, ceramic, air, etc. . . . ) having a dielectric constant e that is greater than or equal to 1 and presenting low loss.

Such layers can either be stacked merely by being juxtaposed and held by external clamping, or else they can be stuck one to another.

All of the layers are preferably defined by a common outline.

The inventors have determined that such a reflector, when properly implemented, has the following properties:

- it reflects electromagnetic energy and concentrates it on a focus;
- it operates in the vicinity of a predetermined fixed frequency;
- it does not reflect electromagnetic waves that do not correspond to its operating frequencies (the reflector thus performs a filtering function);
- the working bandwidth depends on the materials selected and on the number of layers;
- it can provide very low loss, even at very high frequencies; and
- it is made entirely out of dielectric materials that are transparent to electromagnetic waves.

Other characteristics, objects, and advantages of the present invention will appear on reading the following detailed description and from the accompanying drawings, given as non-limiting examples, and in which.

Figure 9:
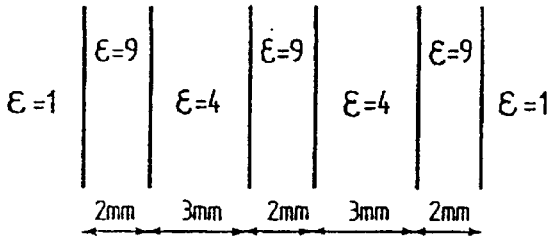
Figure 10:
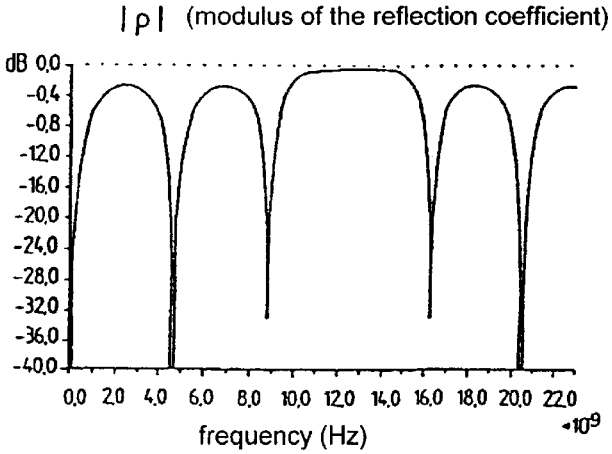
Figure 11:
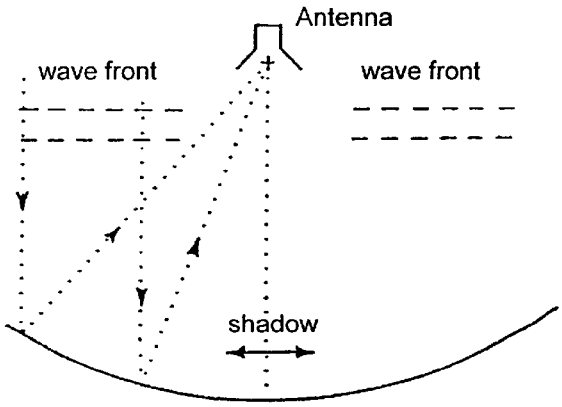
Figure 15:
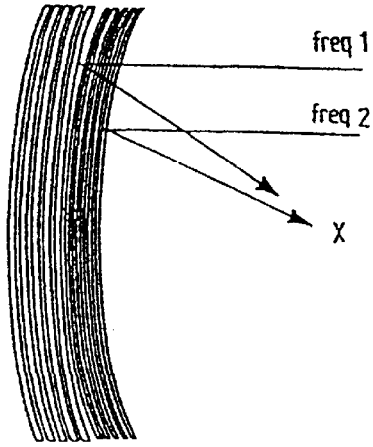
Figure 12:
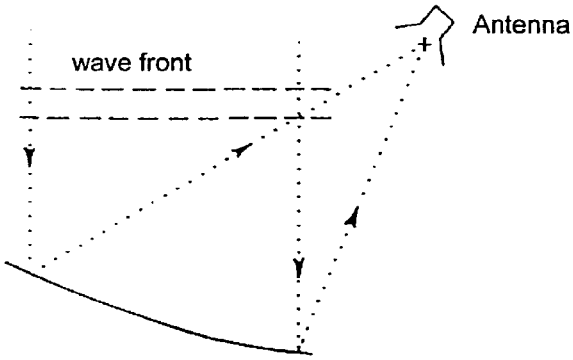
Figure 13:
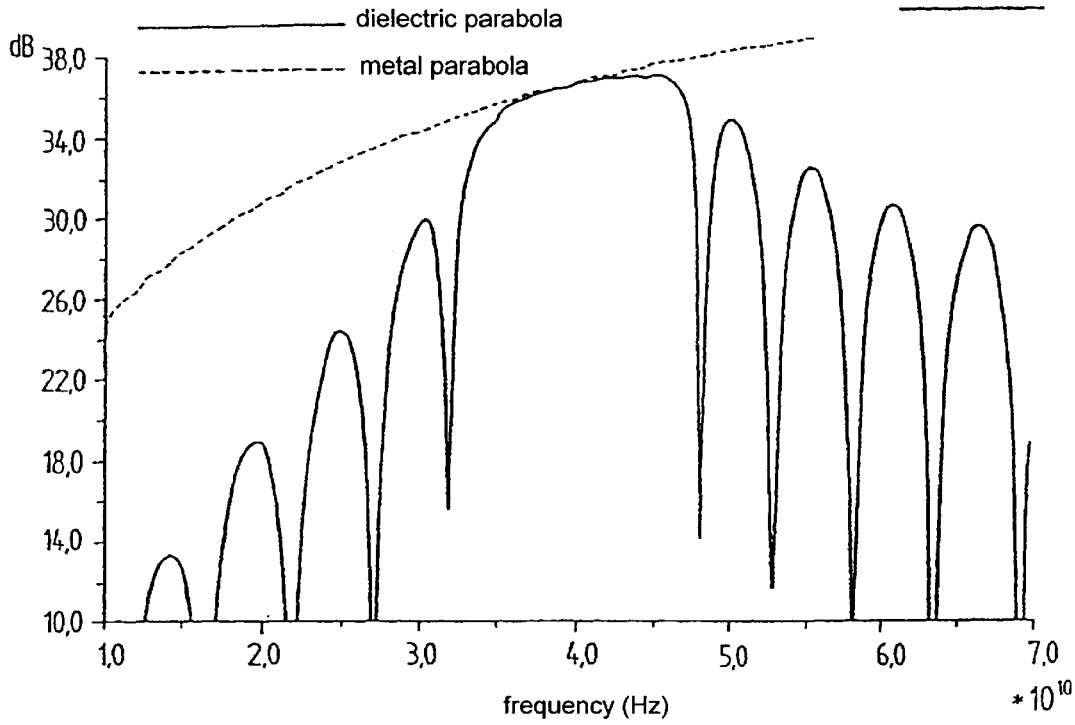
Figure 14:
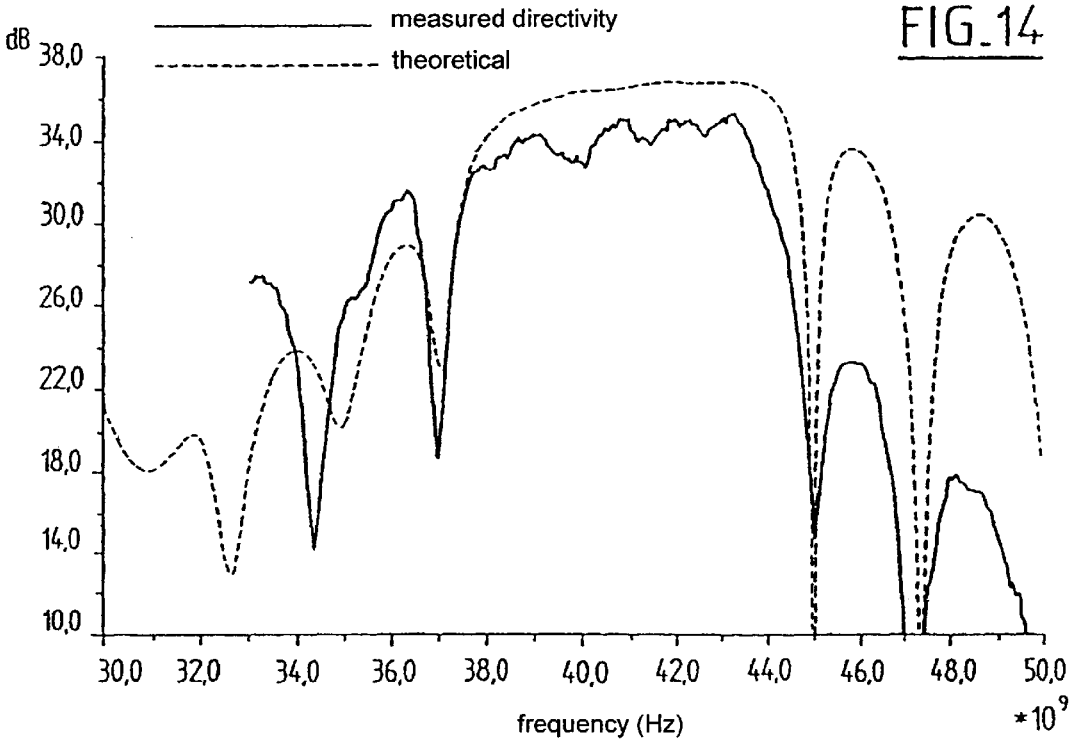

FIGS. 5, 6, 7, and 8 are diagrams showing four variant stackings of layers to illustrate how working bandwidth and reflection coefficients are determined for a parabolic reflector of the present invention;

FIG. 9 shows a particular stack of layers in accordance with the present invention;

FIG. 10 shows the modulus of the reflection coefficient as a function of frequency for the above stack;

FIGS. 11 and 12 are diagrams respectively showing a reflector with a centered focus and a reflector with an off-center focus;

FIG. 13 shows the theoretical directivity of a dielectric reflector in accordance with the present invention;

FIG. 14 shows the directivity as measured on a dielectric reflector of the present invention; and FIG. 15 is a diagram of a dual-band antenna.

Figure 1:
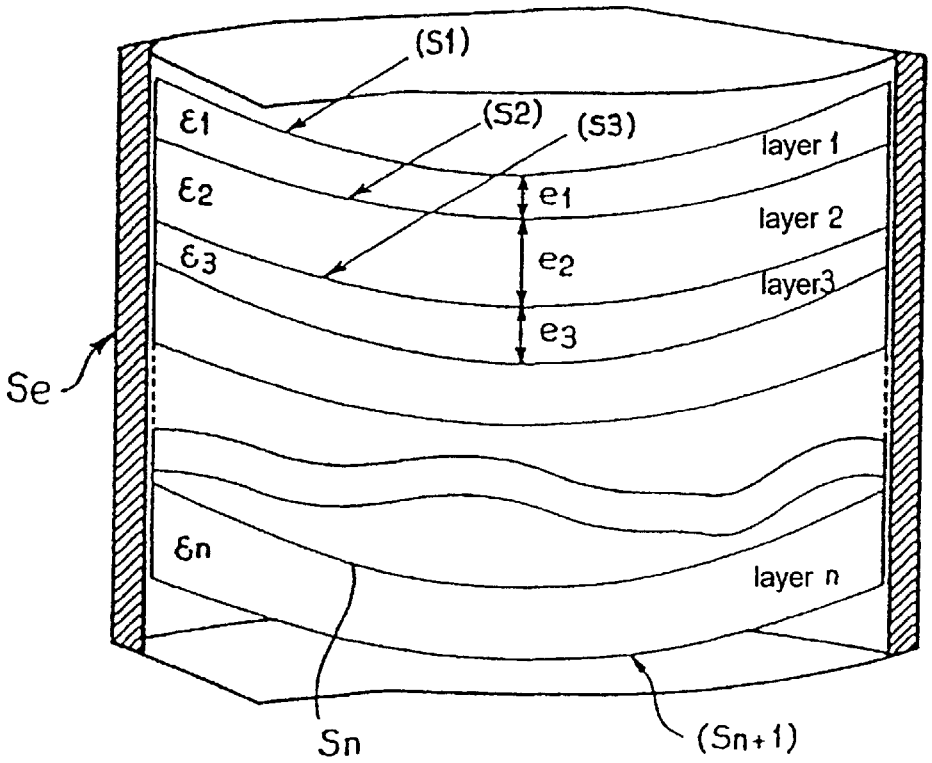
FIG. 1 is a diagrammatic section view of a laminated dielectric reflector of the present invention.

Accompanying FIG. 1 shows a reflector in accordance with the present invention which is constituted by n contiguous layers referenced 1, 2, 3, . . . , n-1, n of dielectric material, with each layer being defined by two parabolic surfaces. Thus, the stack of n layers defines n+1 parabolic surfaces of equations $S_1, S_2, \ldots, S_i, \ldots, S_n, S_{n+1}$. In FIG. 1, the thickness at the center of each of the n layers is referenced $e_1, e_2, e_3$, etc. . . . This thickness e can vary from one layer to another. For any particular layer, it can vary between its center and its periphery.

The outline of the reflector formed by this stack of n layers is referenced C.

Each layer possesses a respective dielectric constant $\in_1, \in_2, \in_3, \ldots, \in_n$.

In the context of the invention, each layer 1 to n is a uniform piece of dielectric material, e.g. plastic, ceramic, air, etc. possessing a dielectric constant $\in$ that is greater than or equal to 1, and presenting low loss.

In FIG. 1, reference Se symbolizes external clamping suitable for holding together the stack of layers formed in this way merely by keeping them juxtaposed.

In a variant, it is possible to envisage sticking said layers to one another.

As mentioned above, it is preferable in the context of the present invention for all of the layers 1 to n to be defined by the same outline C.

In practice, the outline C can have a wide variety of shapes.

In examples that are not limiting but that are preferred, the layers of dielectric material making up a reflector in accordance with the present invention can be rectangular or circular in outline.

The dimensions of the layers, the materials that constitute them, and the relative positioning of each of said layers are preferably selected on the basis of the elements described below so that they present the properties of an excellent reflector in a given frequency band.

The surfaces of the layers 1 to n coincide with paraboloids and their relative positions are identified by the position of the focus of each of the paraboloids.

To describe the surfaces which define the dielectric layers and the relative positions of said surfaces $S_i$, it is necessary to use equations for the paraboloids that involve both the focus $I_i$ and the focal length $f_i$.

The equation of each paraboloid is obtained by the following vector relationship:

$$\|M_iI_i\| + \frac{\|M_iI_i - P_iI_i\|}{f_i} = 2f_i$$

in which $P_i$ is the apex of the paraboloid $S_i$.

Figure 2:
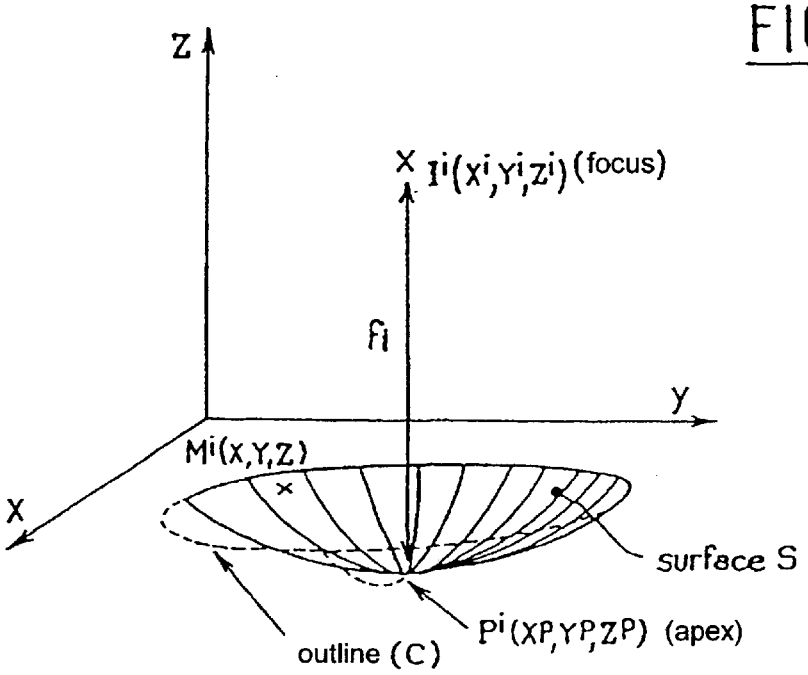
FIG. 2 is a diagram showing a surface of parabolic outline in a rectangular frame of reference for the purpose of defining the equation of a paraboloid.

After projecting this relationship into the rectangular frame of reference shown in FIG. 2 where the axis Z is parallel to the axis interconnecting the apex of each paraboloid and the focus thereof, the surface of the paraboloid is defined by the following equation:

$$(x-x_i)^2+(y-y_i)^2=4f_i(f_i+z-z_i)$$

The surface $S_i$ is formed by the portion of the paraboloid that lies inside the cylinder surrounding the layers. The layers are defined by the outline C.

The juxtaposition of the dielectric layers making up the reflector is then defined by the set of focus and focal length pairs ($I_i$, $f_i$).

Each of these two parameters depends on the operating frequency of the reflector and on the permittivity $\in_i$ of each dielectric layer.

In order to position each of the paraboloidal surfaces, the axis ($I_i$, $P_i$) passing through the focus $I_i$ and the apex $P_i$ of the surface $S_i$ is common to all n+1 parabolic surfaces making up the reflector. In other words, all of the points $I_i$ and $P_i$ are in alignment for all i=1 to i=n+1.

Still more precisely, the reflector can be defined on the basis of the following parameters:

- desired directivity and section of the cylindrical envelope which defines the outline of the dielectric layers;
- radiation pattern;
- the materials available for making the system (different values of $\in_i$);
- the frequency of the electromagnetic signals to be reflected; and
- the working bandwidth around the central operating frequency of the reflector.

When the reflector is illuminated uniformly, its directivity is directly connected to the projected surface area S of the reflector (or the section of the enveloping cylinder) and it is defined by the following relationship:

$$D = \frac{4\pi}{\lambda^2}S$$

in which λ represents wavelength.

When the cylinder which contains the reflector is of rectangular section having dimensions $L_x$ and $L_y$, the theoretical directivity of the reflector when illuminated in uniform manner and ignoring any losses is defined by the following relationship:

$$D = \frac{4\pi}{\lambda^2}L_xL_y$$

in which λ represents wavelength.

When the cylinder which contains the reflector is a circle of radius R, the theoretical directivity of the reflector when illuminated in uniform manner and ignoring all losses is defined by the relationship:

$$D = \frac{4\pi}{\lambda^2}(\pi R^2)$$

in which λ represents wavelength.

The dimensions of the reflector are fixed as a function of the desired directivity by applying the above formulae.

The standardized radiation pattern can be monitored on the basis of the following elements.

This characteristic applies with the laws of radiating apertures.

Figure 4:
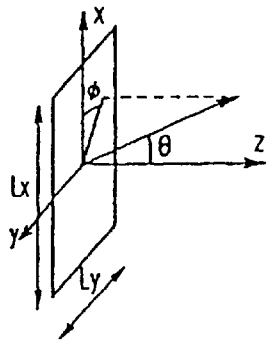
FIG. 4 is a diagram showing the directivity of a reflector of rectangular outline in accordance with the present invention.

For a cylindrical envelope of rectangular shape having sides measuring $L_x$ and $L_y$, the standardized radiation pattern for a rectangular aperture is expressed by the following relationship:

$$f(\theta,\phi) = \frac{\sin\left(\frac{\pi L_x}{\lambda}\sin(\theta)\cos(\phi)\right)}{\frac{\pi L_x}{\lambda}\sin(\theta)\cos(\phi)}\,\frac{\sin\left(\frac{\pi L_y}{\lambda}\sin(\theta)\sin(\phi)\right)}{\frac{\pi L_y}{\lambda}\sin(\theta)\sin(\phi)}$$

in which θ measures the angle from the axis (Oz) of the cylinder and φ measures the angle contained in the plane (O, x, y) of the aperture which has the axis (Ox) as its origin (see FIG. 4).

Figure 3:
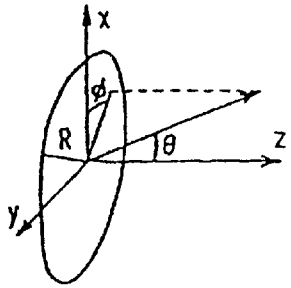
FIG. 3 is a diagram showing the directivity of a cylindrical reflector in accordance with the present invention.

When the cylindrical envelope is a circle of radius R, the standardized radiation pattern for a circular aperture that is illuminated in uniform manner is given by the following law:

$$f(\theta,\phi) = 2\pi R^2\frac{J_1\left(\frac{2\pi R}{\lambda}\sin(\theta)\right)}{\frac{2\pi R}{\lambda}\sin(\theta)}$$

where $J_1$ represents the Bessel function of the first kind and where θ measures the angle from the axis Oz of the cylinder (see FIG. 3).

In the general case, for uniform illumination, the standardized radiation pattern corresponds to the spatial Fourier transform of the shape of the aperture.

The quality of the reflector is essentially defined by the number of layers making it up.

To achieve reflecting power set by specifications at a central frequency of use for the reflector, the number of layers depends on the contrast between the permittivities $\in_1$ of directly adjacent layers.

The law determining variation in layer thickness as a function of permittivity varies with $1/\sqrt{\in}$.

It can be deduced that selecting high values for ∈ makes it possible to reduce the total depth of the reflector. However, using small permittivity values makes it possible to increase the thickness ei of the layers, and in some cases that makes them easier to manufacture (molding, machining, . . . ).

The operating frequency, together with knowledge of the permittivities $\in_i$, serves to determine the distance $e_i$ between the two faces $S_i$ and $S_{i+1}$ of each layer. This distance is measured along the axis $I_i$, $P_i$ which passes through the focus $I_i$ and the apex $P_i$ of the parabolic surface in question.

For an operating frequency centered on a value $f_0$ (in Hertz), the value of the distance $e_i$ (in meters) is calculated on the basis of the following relationship;

$$e_i = \frac{3\times10^8}{4f_0\sqrt{\varepsilon_i}}$$

Knowledge of the distance $e_i$ for each layer makes it possible to position the apexes $P_i$ of the paraboloids relative to one another.

The position of the focus and the focal length for each surface can be determined on the basis of the following elements.

In order to provide satisfactory reflection properties, such a reflector requires the incidence of the electromagnetic waves to be close to normal incidence.

In general, the first focal length $f_1$ is selected in such a manner that the angle θ formed by the incident wave front and tangential to the surface $S_1$ is less than 20°. θ has its greatest value on the largest diameter of the paraboloid.

This gives:

$$f_1 = \frac{R_{\max}}{2\tan\theta_1}$$

in which $R_{max}$ represents the greatest distance between the axis $I_i$, $P_i$ and the outline of the layers.

The parameters of the following surfaces are determined in succession. For this purpose, it is desirable to make use of a digital tool for electromagnetic simulation (e.g. based on finite time differences), and to look for the focal length to be given to each surface.

The values $f_i$ are the only parameters that remain to be determined at this stage of design since the positions of the focuses $I_i$ are a function of the various values of $e_i$ and of $f_i$.

A very good compromise for avoiding too much computation consists in using the same section for all of the layers.

Still more precisely, the focal length $f_i$ of the various parabolic surfaces $S_i$ for obtaining a single common electromagnetic focus are preferably determined as follows.

Each layer is characterized by its thickness $e_i$ given on the axis of revolution of the system, by the focal length $f_i$ defining the concave parabolic surface $S_i$ of the layer, and by the convex parabolic surface $S_{i+1}$ which is of focal length $f_{i+}$.

To study the dielectric reflector, propagation is considered in a plane of symmetry of the reflector. More precisely, the axis of the parabolas must be contained in the plane under study. The focal lengths of the various parabolic interfaces are sought so as to concentrate a maximum amount of electromagnetic energy at the common focus of the reflector.

This operation is performed stepwise, from interface to interface, beginning with the layer which is closest to the focus.

The focal length $f_1$ associated with the surface $S_1$ determines the focal length of the dielectric reflector. I.e. the focus of the reflector as a whole coincides with the focus of the first interface $S_1$. To find the parabolic profile of the second interface, the surface $S_2$ is associated with conditions for total reflection.

$f_2$ is varied in order to concentrate all of the diffracted signal at the assumed focus. To obtain $f_3$, $S_3$ is replaced by an electric wall, and so on until all of the focal lengths have been determined.

In the present state of knowledge, it is generally not possible a priori to know the working frequency bandwidth around the central frequency $f_0$. Nevertheless, this bandwidth can be evaluated for any type of structure by a digital method that is very easy to implement.

The method consists in calculating the wave impedance reduced to the first interface $S_1$. Computation must be performed in complex number space. To begin resolution, the effect of the last layer n at interface n is reduced. The result gives the impedance seen by the electromagnetic wave at interface n. The same reasoning is repeated to determine the impedance seen at interface n−1, and so on until the impedance is known on the first interface $S_1$.

Figure 5:
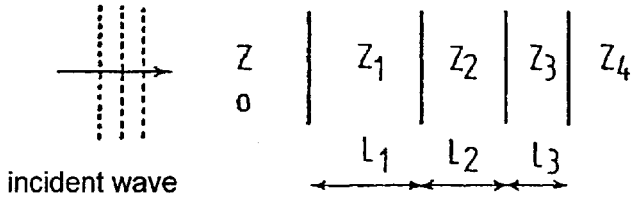

Assume a stack of three layers $z_1$, $Z_2$, and $z_3$ of respective thicknesses $L_1$, $L_2$, and $L_3$ situated between two media $z_0$, $z_4$ extending transversely to the incident wave as shown diagrammatically in FIG. 5, the wave impedance is given by:

$$Z_i = \frac{377}{\sqrt{\varepsilon_i}}$$

Figure 6:
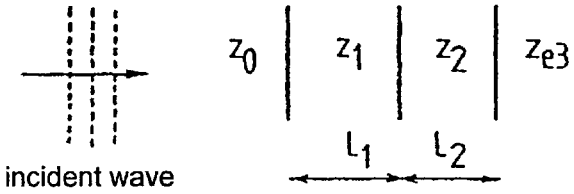
Figure 7:
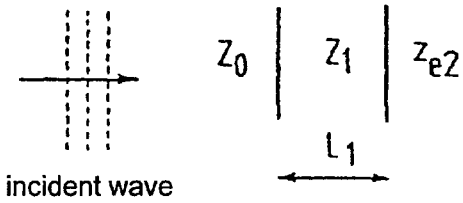

The last interface between $z_3$ and $z_4$ is eliminated and the layer 3 is replaced by a medium of impedance $Z_{e3}$ (see FIG. 6). This gives:

$$Ze_3 = Z_3\frac{Z_4 + j\cdot Z_3\cdot\tan\left(\frac{2\pi f}{3\times10^8}\cdot L_3\cdot\varepsilon_3^{-2}\right)}{Z_3 + j\cdot Z_4\cdot\tan\left(\frac{2\pi f}{3\times10^8}\cdot L_3\cdot\varepsilon_3^{-2}\right)}$$

The following step applies the same reasoning. It involves eliminating the interface between $Z_2$ and $Z_{e3}$ and replacing layer 2 by a medium of impedance $Z_{e2}$ (see FIG. 7).

This gives:

$$Ze_2 = Z_2\frac{Z_{e3} + j\cdot Z_2\cdot\tan\left(\frac{2\pi f}{3\times10^8}\cdot L_3\cdot\varepsilon_2^{-2}\right)}{Z_2 + j\cdot Z_{e3}\cdot\tan\left(\frac{2\pi f}{3\times10^8}\cdot L_3\cdot\varepsilon_2^{-2}\right)}$$

Figure 8:
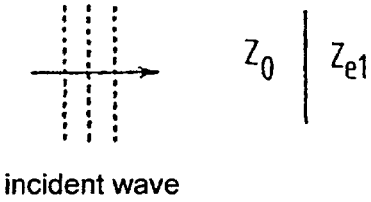

The operation is repeated until the layers are replaced by a single interface between the incident medium (generally air) and an infinite medium of equivalent impedance $Z_{e1}$ (see FIG. 8).

This gives:

$$Ze_1 = Z_1\frac{Z_{e2} + j\cdot Z_1\cdot\tan\left(\frac{2\pi f}{3\times10^8}\cdot L_1\cdot\varepsilon_1^{-2}\right)}{Z_1 + j\cdot Z_{e2}\cdot\tan\left(\frac{2\pi f}{3\times10^8}\cdot L_1\cdot\varepsilon_1^{-2}\right)}$$

Once the impedance of the laminated medium has been reduced to the level of the first interface, it is possible to calculate the reflection coefficient at normal incidence on the basis of the following relationship:

$$\rho = \frac{Z_{el} - Z_0}{Z_{el} + Z_0}$$

The modulus and the phase of the reflection coefficient are known so the usable frequency band of the reflector can be assessed.

FIG. 9 is a diagram showing an example of a plurality of layers having different dielectric constants.

More precisely, in the invention shown in FIG. 9, the structure comprises:

- an incident medium formed by air that possesses a dielectric constant ∈ equal to 1;
- a first layer that is 2 millimeters (mm) thick and that has a dielectric constant ∈ equal to 9;
- a second layer that is 3 mm thick and that has a dielectric constant ∈ equal to 4;

a third layer that is2 mm thick, having a dielectric constant $\in$ equal to 9;

a fourth layer that is 3 mm thick, having a dielectric constant $\in$ equal to 4;

a fifth layer that is 2 mm thick, having a dielectric constant $\in$ equal to 9; and a surrounding medium which is constituted by air for which $\in$ is equal to 1.

The modulus of the reflection coefficient obtained by performing computation on the basis of the above structure is shown in FIG. 10.

The person skilled in the art knows that a parabolic reflector used for reflection concentrates onto its focus the incident energy that comes from its pointing direction (the direction of the axis $(I_i, P_i)$).

This principle remains identical for all types of parabolic reflector.

Nevertheless, two families can be distinguished: reflectors having a centered focus and reflectors having a focus that is off-center.

For a reflector having a centered focus, the focus lies on the path of the incident wave, as shown in FIG. 11. This means that the system for receiving the electromagnetic energy casts a shadow in the incident beam.

In contrast, when the focus is off-center, the working area of the reflector need no longer be in the shadow of the focus.

The received antenna situated at the focus therefore no longer interferes with the incident field.

That is why, in the context of the present invention, it is preferable to use reflectors having an off-center focus.

In the context of the present invention, it is possible to design a reflector that possesses only two types of dielectric.

Further simplification can consist in using air as one of the dielectrics, which amounts to using only one single solid material so as to constitute the alternating second dielectric.

Under such circumstances, the reflector is made up of alternating dielectric layers of $\in_1$ and of $\in_2=1$ (for air).

The minimum number of dielectric layers that is necessary to obtain a reflection coefficient close to 100% in the working bandwidth of the reflector is given in the following table:

| | | | | | | | | | |
|---|---|---|---|---|---|---|---|---|---|
| $\epsilon_1$ | 2 | 3 | 4 | 5 | 6 | 7 | 8 | 9 | 10 |
| $\epsilon_2$ | 1 | 1 | 1 | 1 | 1 | 1 | 1 | 1 | 1 |
| number of layers $\epsilon_1$ | 8 | 6 | 5 | 4 | 4 | 4 | 4 | 3 | 3 |

If the intermediate dielectric is not air ($\in_2 \neq 1$), then the permittivity contrast between $\in_1$ and $\in_2$ is smaller so the number of layers needed is increased.

In particular, the inventors have made a parabolic $\in$ with a centered focus contained in a circular section cylinder having a diameter of 16 centimeters (cm) using a dielectric $\in_1=\in_r=2.5$ and surfaces that are computed by digital simulation on the basis of the method of finite time differences. The resulting reflector operates at around 40 GHz.

Accompanying FIG. 13 shows the theoretical directivity of this parabolic reflector made of dielectric material in accordance with the present invention and plotted as a continuous line, and the same figure also shows the theoretical curve for the directivity of a metal parabolic reflector having the same focal length and the same radius r=8 cm, with this being plotted as a dashed line.

The directivity curves shown in FIG. 13 are plotted as a function of frequency.

The inventors have also made another parabolic reflector using layers made out of a single material alternating with air interfaces. The dielectric layers in question had a dielectric constant $\in_r=2.38$. Only two parabolic surfaces $S_1$ and $S_2$ were defined. As mentioned above, these identical layers with $\in_r=2.38$ were superposed in alternation with layers of air. In particular, the inventors have made reflectors having seven identical layers of $\in_r$ alternating with layers of air.

This reflector was likewise designed to operate at around 40 GHz and its dimensions and the shape of its outline were identical to the preceding example, i.e. a circular cylinder having a diameter D=16 cm.

The theoretical directivity curve for this reflector as a function of frequency and the real directivity curve as measured, still as a function of frequency, are given in FIG. 14.

It can be seen from these directivity curves as a function of frequency that the reflection power oscillates slightly (1 dB) within the working frequency band.

The difference of about 2 dB between theory and measurement can be attributed to the influence of the shadow zone of the receiver horn situated at the focus of the reflector.

In computing the theoretical directivity, this shadow zone was not taken into consideration.

Finally, the inventors have found that laminated dielectric reflectors obtained in this way present the following technical advantages:

these types of reflector operate around a frequency $f_0$ that is predefined during design;

the useful frequency bandwidth around $f_0$ can be adjusted by an appropriate selection of the materials used;

using materials having low dielectric loss makes it possible to envisage reflectors that operate at very high frequencies;

outside the working bandwidth, the reflector remains transparent to electromagnetic waves. This property can be used to resolve problems of compatibility, of antenna decoupling, or of electromagnetic furtiveness;

machining tolerances for these reflectors are slacker than for metal parabolas; and it is possible to envisage inserting one or more defects in the material so as to interrupt dielectric periodicity. This can make it possible to create a transmission peak in the frequency band that is initially reflected by the reflector. This feature can enable possible electromagnetic parasitic radiation to be disposed of. Such a defect can be formed by including within a stack of layers that comply with given periodicity, one or more special layers that are different and that do not comply with said periodicity, or by omitting one or more layers from the periodicity. Such a break at one or more locations in the periodicity of the stack makes it possible to create frequency bands within the reflection band of the reflector at which energy passes through the structure without reaching the focus. Such an arrangement can provide the assembly with a frequency filtering function and possibly also with a space filtering function. The device can thus respond in two completely different manners at two adjacent frequencies: it can be transparent at the first frequency and it can concentrate energy on the focus at the second frequency.

It will also be observed that with industrial manufacture, the dielectric layers can be obtained by molding a plastics material, which implies a manufacturing cost that is low.

Furthermore, in use, selecting materials having very low dielectric loss can make it possible to improve the efficiency of systems at frequencies where metallic losses in conventional reflectors become high.

Particular embodiments of reflectors in accordance with the present invention are described below that are based on dielectric layers all made of the same material and all identical.

a) An Anti-collision Radar Reflector for Cars

Such a system is designed to operate in the vicinity of a frequency of 75 GHz. For reasons of cost, the feasibility of a dielectric reflector made of materials having permittivities close to those of commonly used plastics materials has been investigated. At such frequencies, the diameter of the reflector is about 80 mm. In addition, the examples proposed relate to layers having permittivity $\in_1$ that is the same for all of the layers.

First example: $\in_1$=2.2 and $\in_2$=1 (seven layers of $\in_1$ and six layers of air).

| Layer No. | $\epsilon_1$ | $e_i$ | surface | $f_i$ |
|---|---|---|---|---|
| 1 | 2.2 | 6.7E-4 | $S_1$ | 4E-2 |
| | | | $S_2$ | 4.2E-2 |
| 2 | 1 | 1E-3 | air | |
| 3 | 2.2 | 6.7E-4 | $S_3$ | 4E-2 |
| | | | $S_4$ | 4.2E-2 |
| 4 | 1 | 1E-3 | air | |
| 5 | 2.2 | 6.7E-4 | $S_5$ | 4E-2 |
| | | | $S_6$ | 4.2E-2 |
| 6 | 1 | 1E-3 | air | |
| 7 | 2.2 | 6.7E-4 | $S_7$ | 4E-2 |
| | | | $S_8$ | 4.2E-2 |
| 8 | 1 | 1E-3 | air | |
| 9 | 2.2 | 6.7E-4 | $S_9$ | 4E-2 |
| | | | $S_{10}$ | 4.2E-2 |
| 10 | 1 | 1E-3 | air | |
| 11 | 2.2 | 6.7E-4 | $S_{11}$ | 4E-2 |
| | | | $S_{12}$ | 4.2E-2 |
| 12 | 1 | 1E-3 | air | |
| 13 | 2.2 | 6.7E-4 | $S_{13}$ | 4E-2 |
| | | | $S_{14}$ | 4.2E-2 |

Second example: $\in_1$=3 (six layers of $\in_1$ and five of air).

| Layer No. | $\epsilon_1$ | $e_i$ | surface | $f_i$ |
|---|---|---|---|---|
| 1 | 3 | 5.8E-4 | $S_1$ | 4E-2 |
| | | | $S_2$ | 4.15E-2 |
| 2 | 1 | 1E-3 | air | |
| 3 | 3 | 5.8E-4 | $S_3$ | 4E-2 |
| | | | $S_4$ | 4.15E-2 |
| 4 | 1 | 1E-3 | air | |
| 5 | 3 | 5.8E-4 | $S_5$ | 4E-2 |
| | | | $S_6$ | 4.15E-2 |
| 6 | 1 | 1E-3 | air | |
| 7 | 3 | 5.8E-4 | $S_7$ | 4E-2 |
| | | | $S_8$ | 4.15E-2 |
| 8 | 1 | 1E-3 | air | |
| 9 | 3 | 5.8E-4 | $S_9$ | 4E-2 |
| | | | $S_{10}$ | 4.15E-2 |
| 10 | 1 | 1E-3 | air | |
| 11 | 3 | 5.8E-4 | $S_{11}$ | 4E-2 |
| | | | $S_{12}$ | 4.15E-2 |

In these two examples, the focal length $f_1$ was arbitrarily to be 0.04 meters (m). Naturally, the present invention is not limited to this focal length particular pairs of permittivities ($\in_1$, $\in_2$) given above.

b) A Parabola for TV Reception

TV reception takes place at 12 GHz. An example of a dielectric parabola is proposed having seven identical layers made of a material having permittivity $\in_1$=2.4. These layers alternate with six layers of air ($\in_2$=1). Focus length was arbitrarily selected so that $f_1$=40 cm. Other magnitudes for $f_1$, $\in_1$, and $\in_2$ could be envisaged.

| Layer No. | $\epsilon_1$ | $e_i$ | surface | $f_i$ |
|---|---|---|---|---|
| 1 | 2.4 | 4.03E-3 | $S_1$ | 0.4 m |
| | | | $S_2$ | 0.415 m |
| 2 | 1 | 6.25E-3 | air | |
| 3 | 2.4 | 4.03E-3 | $S_3$ | 0.4 m |
| | | | $S_4$ | 0.415 m |
| 4 | 1 | 6.25E-3 | air | |
| 5 | 2.4 | 4.03E-3 | $S_5$ | 0.4 m |
| | | | $S_6$ | 0.415 m |
| 6 | 1 | 6.25E-3 | air | |
| 7 | 2.4 | 4.03E-3 | $S_7$ | 0.4 m |
| | | | $S_8$ | 0.415 m |
| 8 | 1 | 6.25E-3 | air | |
| 9 | 2.4 | 4.03E-3 | $S_9$ | 0.4 m |
| | | | $S_{10}$ | 0.415 m |
| 10 | 1 | 6.25E-3 | air | |
| 11 | 2.4 | 4.03E-3 | $S_{11}$ | 0.4 m |
| | | | $S_{12}$ | 0.415 m |
| 12 | 1 | 6.25E-3 | air | |
| 13 | 2.4 | 4.03E-3 | $S_{13}$ | 0.4 m |
| | | | $S_{14}$ | 0.415 m |

c) A Parabolic Reflector for a Dual-Band Antenna

For a system that is to focus electromagnetic energy in two separate frequency bands, two systems designed to operate at different frequencies can be superposed, as shown diagrammatically in FIG. 15.

It is thus possible to make a reflector in accordance with the present invention having two operating modes. Such a reflector can be used to operate at around freq1=4 GHz and freq2=5.6 GHz, for example.

The antenna can be made up of two groups each of six dielectric layers of permittivity $\in_1$=3. These layers alternate with air ($\in_2$=1). The first group of dielectric layers reflects and concentrates electromagnetic energy contained in the first working frequency band and the second group of layers concentrates energy contained in the second frequency band. The diameter of the reflector is about 180 cm. The choice of $\in_1$, $\in_2$ and of the focal lengths can be adapted to the desired working frequency bands and to the materials available.

Such a reflector can satisfy the following characteristics:

| Layer No. | $\epsilon_1$ | $e_i$ | surface | $f_i$ |
|---|---|---|---|---|
| 1 | 3 | 7.6E-3 | $S_1$ | 1.2 m |
| | | | $S_2$ | 1.21 m |
| 2 | 1 | 13.2E-3 | air | |
| 3 | 3 | 7.6E-3 | $S_3$ | 1.2 m |
| | | | $S_4$ | 1.21 m |
| 4 | 1 | 13.2E-3 | air | |
| 5 | 3 | 7.6E-3 | $S_5$ | 1.2 m |
| | | | $S_6$ | 1.21 m |
| 6 | 1 | 13.2E-3 | air | |
| 7 | 3 | 7.6E-3 | $S_7$ | 1.2 m |
| | | | $S_8$ | 1.21 m |
| 8 | 1 | 13.2E-3 | air | |
| 9 | 3 | 7.6E-3 | $S_9$ | 1.2 m |
| | | | $S_{10}$ | 1.21 m |
| 10 | 1 | 13.2E-3 | air | |
| 11 | 3 | 7.6E-3 | $S_{11}$ | 1.2 m |
| | | | $S_{12}$ | 1.21 m |
| 12 | 1 | 10.E-3 | air | |
| 13 | 3 | 11.4E-3 | $S_{13}$ | 1.38 m |
| | | | $S_{14}$ | 1.38 m |

-continued

| Layer No. | $\epsilon_1$ | $e_i$ | surface | $f_i$ |
|---|---|---|---|---|
| 14 | 1 | 19.7E-3 | | air |
| 15 | 3 | 11.4E-3 | $S_{15}$ | 1.38 m |
| | | | $S_{16}$ | 1.38 m |
| 16 | 1 | 19.7E-3 | | air |
| 17 | 3 | 11.4E-3 | $S_{17}$ | 1.38 m |
| | | | $S_{18}$ | 1.38 m |
| 18 | 1 | 19.7E-3 | | air |
| 19 | 3 | 11.4E-3 | $S_{19}$ | 1.38 m |
| | | | $S_{20}$ | 1.38 m |
| 20 | 1 | 19.7E-3 | | air |
| 21 | 3 | 11.4E-3 | $S_{21}$ | 1.38 m |
| | | | $S_{22}$ | 1.38 m |
| 22 | 1 | 19.7E-3 | | air |
| 23 | 3 | 11.4E-3 | $S_{23}$ | 1.38 m |
| | | | $S_{24}$ | 1.38 m |

Naturally, the present invention is not limited to the particular embodiment described above, but extends to any variant within the spirit of the invention.

In a variant embodiment in accordance with the present invention, one of the materials used can have electrical characteristics (permittivity, permeability) that vary as a function of some external source. The operating frequency band in reflection of the reflector then becomes dependent on the level applied by the external source. The operating band in reflection and the bands in transmission can then be controlled.

In the above tables, the terms E-2, E-3, E-4 should be understood respectively as $10^{-2}$m, $10^{-3}$m, and $10^{-4}$m.

It should be observed that in the reflector of the present invention, the distinct respective geometrical focuses of the various parabolic surfaces used do not coincide with the electromagnetic focus, i.e. the concentration focus for an electromagnetic beam reaching the reflector with incidence parallel to the axis of the reflector. As mentioned above, the electromagnetic focus of the reflector coincides with the geometrical focus of the first concave parabolic surface. The offset that exists between the electromagnetic focuses and the geometrical focuses of the following parabolic surfaces are the result of the fact that the waves reflected at said following interfaces do not reach the respective geometrical focuses of said interfaces, but reach the common electromagnetic focus because said waves are subjected to the cumulative effect of the preceding layers which they pass through in both the go and return directions.

What is claimed is:

1. A reflector forming a parabolic antenna, constituted only and integrally by a plurality n of contiguous layers of dielectric material defined by n+1 surfaces of parabolic equations; said n+1 surfaces of parabolic equations being distinct from one to another and having each a respective geometrical focus which is distinct from the geometrical focus of each one of the other n surfaces of parabolic equations, wherein the geometrical focus of a first parabolic surface coincides with the electromagnetic focus of the reflector, while the geometrical focus of each one of the n following parabolic surfaces is offset, in regard of the common electromagnetic focus taking into account the shifting operated on the electromagnetic waves when passing through the various preceding layers to be found on the path of the electromagnetic waves between said surface and the electromagnetic focus, so that the shifting between the geometrical focuses of the n+1 surfaces of parabolic equations defines a common electromagnetic focus where all electromagnetic waves reflected by all the n+1 surfaces meet.

2. A reflector according to claim 1, characterized by the fact that each layer is constituted by a piece of uniform dielectric having a dielectric constant $\in$ greater than or equal to 1 and presenting low loss.

3. A reflector according to claim 1, characterized by the fact that all of the layers are defined by the same external circumference.

4. A reflector according to claim 1, characterized by the fact that the layers are stacked merely by being juxtaposed and they are held together by external clamping.

5. A reflector according to claim 1, characterized by the fact that the layers are stuck to one another.

6. A reflector according to claim 1, characterized by the fact that said reflector possesses a rectangular external circumference.

7. A reflector according to claim 1, characterized by the fact that said reflector has an external circumference that is circular.

8. A reflector according to claim 1, characterized by the fact that the distance $e_i$ between the two faces $S_i$ and $S_{i+1}$ of each layer is determined on the basis of the following relationship:

$$e_i = \frac{3 \times 10^8}{4 f_0 \sqrt{\varepsilon_1}}.$$

9. A reflector according to claim 1, characterized by the fact that a first focal length is selected in such a manner that the angle θ formed by the incident wave front and tangential to the surface at a margin of the layer remains less than 20°.

10. A reflector according to claim 1, characterized by the fact that working bandwidth of said reflector is determined by computing the wave impedance reduced to the level of the first interface by iteratively eliminating the last interface and replacing the last-but-one layer with a medium of suitable impedance.

11. A reflector according to claim 1, characterized by the fact that said reflector possesses a focus that is off-centered relative to the antenna.

12. A reflector according to claim 1, characterized by the fact that said reflector is made up of two types of dielectric only.

13. A reflector according to claim 1, characterized by the fact that said reflector uses air as a dielectric.

14. A reflector according to claim 1, characterized by the fact that said reflector is made up of alternating layers of solid dielectric material and of air.

15. A reflector according to claim 1, characterized by the fact that said reflector includes a defect that breaks its dielectric periodicity, so as to create a transmission peak in its frequency band.

16. A reflector according to claim 15, characterized by the fact that the defect is formed by including within a stack of layers that comply with given periodicity at least one different special layer that does not comply with said periodicity, or by the omission of at least one layer from the periodicity.

17. A reflector according to claim 1, characterized by the fact that the focus-apex axes are in alignment for all of the parabolic surfaces.

18. A reflector according to claim 1, characterized by the fact that said reflector is made up of a stack of layers presenting alternating permittivities $\in_1$ and $\in_2$, and that the number of layers is as follows:

| | | | | | | | | | |
|---|---|---|---|---|---|---|---|---|---|
| $\epsilon_1$ | 2 | 3 | 4 | 5 | 6 | 7 | 8 | 9 | 10 |
| $\epsilon_2$ | 1 | 1 | 1 | 1 | 1 | 1 | 1 | 1 | 1 |
| number of layers $\epsilon_1$ | 8 | 6 | 5 | 4 | 4 | 4 | 4 | 3 | 3. |

19. A reflector according to claim 1, characterized by the fact that said reflector has seven layers of permittivity $\in_1>1$ alternating with six layers of air.

20. A reflector according to claim 19, characterized by the fact that said reflector comprises seven layers of permittivity $\in_1=2.2$ alternating with six layers of air.

21. A reflector according to claim 19, characterized by the fact that said reflector comprises layers that comply with the following table:

| Layer No. | $\epsilon_1$ | $e_i$ | surface | $f_i$ |
|---|---|---|---|---|
| 1 | 2.2 | 6.7E-4 | $S_1$ | 4E-2 |
| | | | $S_2$ | 4.2E-2 |
| 2 | 1 | 1E-3 | air | |
| 3 | 2.2 | 6.7E-4 | $S_3$ | 4E-2 |
| | | | $S_4$ | 4.2E-2 |
| 4 | 1 | 1E-3 | air | |
| 5 | 2.2 | 6.7E-4 | $S_5$ | 4E-2 |
| | | | $S_6$ | 4.2E-2 |
| 6 | 1 | 1E-3 | air | |
| 7 | 2.2 | 6.7E-4 | $S_7$ | 4E-2 |
| | | | $S_8$ | 4.2E-2 |
| 8 | 1 | 1E-3 | air | |
| 9 | 2.2 | 6.7E-4 | $S_9$ | 4E-2 |
| | | | $S_{10}$ | 4.2E-2 |
| 10 | 1 | 1E-3 | air | |
| 11 | 2.2 | 6.7E-4 | $S_{11}$ | 4E-2 |
| | | | $S_{12}$ | 4.2E-2 |
| 12 | 1 | 1E-3 | air | |
| 13 | 2.2 | 6.7E-4 | $S_{13}$ | 4E-2 |
| | | | $S_{14}$ | 4.2E-2 |

in which $e_i$ resents the distance between the two faces of each layer measured on the axis of revolution, and $f_i$ represents the focal length of each of said faces.

22. A reflector according to claim 19, characterized by the fact that said reflector comprises seven layers of permittivity $\in_1=2.4$ alternating with six layers of air.

23. A reflector according to claim 19, characterized by the fact that said reflector comprises that comply with the following table:

| Layer No. | $\epsilon_1$ | $e_i$ | surface | $f_i$ |
|---|---|---|---|---|
| 1 | 2.4 | 4.03E-3 | $S_1$ | 0.4 m |
| | | | $S_2$ | 0.415 m |
| 2 | 1 | 6.25E-3 | air | |
| 3 | 2.4 | 4.03E-3 | $S_3$ | 0.4 m |
| | | | $S_4$ | 0.415 m |
| 4 | 1 | 6.25E-3 | air | |
| 5 | 2.4 | 4.03E-3 | $S_5$ | 0.4 m |
| | | | $S_6$ | 0.415 m |
| 6 | 1 | 6.25E-3 | air | |
| 7 | 2.4 | 4.03E-3 | $S_7$ | 0.4 m |
| | | | $S_8$ | 0.415 m |
| 8 | 1 | 6.25E-3 | air | |
| 9 | 2.4 | 4.03E-3 | $S_9$ | 0.4 m |
| | | | $S_{10}$ | 0.415 m |
| 10 | 1 | 6.25E-3 | air | |
| 11 | 2.4 | 4.03E-3 | $S_{11}$ | 0.4 m |
| | | | $S_{12}$ | 0.415 m |

-continued

| Layer No. | $\epsilon_1$ | $e_i$ | surface | $f_i$ |
|---|---|---|---|---|
| 12 | 1 | 6.25E-3 | air | |
| 13 | 2.4 | 4.03E-3 | $S_{13}$ | 0.4 m |
| | | | $S_{14}$ | 0.415 m |

in which $e_i$ presents the distance between the two faces of each layer measured on the axis of revolution, and $f_i$ represents the focal length of each of said faces.

24. A reflector according to claim 1, characterized by the fact that said reflector comprises six layers of permittivity $\in_1>1$ alternating with five layers of air.

25. A reflector according to claim 24, characterized by the fact that said reflector comprises six layers of permittivity $\in_1=3$ alternating with five layers of air.

26. A reflector according to claim 24, characterized by the fact that said reflector comprises layers complying with the following table:

| Layer No. | $\epsilon_1$ | $e_i$ | surface | $f_i$ |
|---|---|---|---|---|
| 1 | 3 | 5.8E-4 | $S_1$ | 4E-2 |
| | | | $S_2$ | 4.15E-2 |
| 2 | 1 | 1E-3 | air | |
| 3 | 3 | 5.8E-4 | $S_3$ | 4E-2 |
| | | | $S_4$ | 4.15E-2 |
| 4 | 1 | 1E-3 | air | |
| 5 | 3 | 5.8E-4 | $S_5$ | 4E-2 |
| | | | $S_6$ | 4.15E-2 |
| 6 | 1 | 1E-3 | air | |
| 7 | 3 | 5.8E-4 | $S_7$ | 4E-2 |
| | | | $S_8$ | 4.15E-2 |
| 8 | 1 | 1E-3 | air | |
| 9 | 3 | 5.8E-4 | $S_9$ | 4E-2 |
| | | | $S_{10}$ | 4.15E-2 |
| 10 | 1 | 1E-3 | air | |
| 11 | 3 | 5.8E-4 | $S_{11}$ | 4E-2 |
| | | | $S_{12}$ | 4.15E-2 |

in which $e_i$ represents the distance between the two faces of each layer measured on the axis of revolution, and $f_i$ represents the focal length of each of said faces.

27. A reflector according to claim 21, characterized by the fact that said reflector constitutes a reflector for an anti-collision radar for cars.

28. A reflector according to claim 23, characterized by the fact that said reflector constitutes a TV reception parabola.

29. A reflector according to claim 1, characterized by the fact that said reflector is formed by superposing two subassemblies each adapted to operate at different frequencies and themselves formed by respective stacks of contiguous layers of dielectric material.

30. A reflector according to claim 29, characterized by the fact that said reflector is made up of two groups of six dielectric layers of permittivity $\in_1=3$ alternating with layers of air.

31. A reflector according to claim 29, characterized by the fact that the layers with the following table:

| Layer No. | $\epsilon_1$ | $e_i$ | surface | $f_i$ |
|---|---|---|---|---|
| 1 | 3 | 7.6E-3 | $S_1$ | 1.2 m |
| | | | $S_2$ | 1.21 m |
| 2 | 1 | 13.2E-3 | air | |

-continued

| Layer No. | $\epsilon_1$ | $e_i$ | surface | $f_i$ |
|---|---|---|---|---|
| 3 | 3 | 7.6E-3 | $S_3$ | 1.2 m |
| | | | $S_4$ | 1.21 m |
| 4 | 1 | 13.2E-3 | air | |
| 5 | 3 | 7.6E-3 | $S_5$ | 1.2 m |
| | | | $S_6$ | 1.21 m |
| 6 | 1 | 13.2E-3 | air | |
| 7 | 3 | 7.6E-3 | $S_7$ | 1.2 m |
| | | | $S_8$ | 1.21 m |
| 8 | 1 | 13.2E-3 | air | |
| 9 | 3 | 7.6E-3 | $S_9$ | 1.2 m |
| | | | $S_{10}$ | 1.21 m |
| 10 | 1 | 13.2E-3 | air | |
| 11 | 3 | 7.6E-3 | $S_{11}$ | 1.2 m |
| | | | $S_{12}$ | 1.21 m |
| 12 | 1 | 10.E-3 | air | |
| 13 | 3 | 11.4E-3 | $S_{13}$ | 1.38 m |
| | | | $S_{14}$ | 1.38 m |
| 14 | 1 | 19.7E-3 | air | |
| 15 | 3 | 11.4E-3 | $S_{15}$ | 1.38 m |
| | | | $S_{16}$ | 1.38 m |
| 16 | 1 | 19.7E-3 | air | |
| 17 | 3 | 11.4E-3 | $S_{17}$ | 1.38 m |
| | | | $S_{18}$ | 1.38 m |

-continued

| Layer No. | $\epsilon_1$ | $e_i$ | surface | $f_i$ |
|---|---|---|---|---|
| 18 | 1 | 19.7E-3 | air | |
| 19 | 3 | 11.4E-3 | $S_{19}$ | 1.38 m |
| | | | $S_{20}$ | 1.38 m |
| 20 | 1 | 19.7E-3 | air | |
| 21 | 3 | 11.4E-3 | $S_{21}$ | 1.38 m |
| | | | $S_{22}$ | 1.38 m |
| 22 | 1 | 19.7E-3 | air | |
| 23 | 3 | 11.4E-3 | $S_{23}$ | 1.38 m |
| | | | $S_{24}$ | 1.38 m |

in which $e_i$ represents the distance between two faces of each layer measured on the axis for revolution, and $f_i$ represents the focal length of each of said faces.

32. A reflector according to claim 1, characterized by the fact that one of the materials used has electrical characteristics such as permittivity and/or permeability that are variable as a function of an external source.

* * * * *

UNITED STATES PATENT AND TRADEMARK OFFICE

CERTIFICATE OF CORRECTION

PATENT NO. : 6,456,254 B1
DATED : September 24, 2002
INVENTOR(S) : Reineix et al.

It is certified that error appears in the above-identified patent and that said Letters Patent is hereby corrected as shown below:

Column 13,
Line 39, please delete “resents” and insert -- represents --.

Column 14,
Line 9, please delete “presents” and insert -- represents --.

Signed and Sealed this

Seventeenth Day of August, 2004

JON W. DUDAS
*Acting Director of the United States Patent and Trademark Office*